US007493760B2

(12) United States Patent
Oda et al.

(10) Patent No.: US 7,493,760 B2
(45) Date of Patent: Feb. 24, 2009

(54) STEAM ENGINE

(75) Inventors: Shuzo Oda, Kariya (JP); Shinichi Yatsuzuka, Chiryu (JP); Katsuya Komaki, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/717,795

(22) Filed: Mar. 13, 2007

(65) Prior Publication Data

US 2007/0214783 A1 Sep. 20, 2007

(30) Foreign Application Priority Data

Mar. 17, 2006 (JP) ..... 2006-074984

(51) Int. Cl.
*F01B 1/00* (2006.01)

(52) U.S. Cl. ..... 60/508; 60/670

(58) Field of Classification Search ..... 60/508–515, 60/670

See application file for complete search history.

(56) References Cited

U.S. PATENT DOCUMENTS 6,931,852 B2 * 8/2005 Yatsuzuka et al. ..... 60/670
6,973,788 B2 * 12/2005 Oda et al. ..... 60/645
2004/0060294 A1 4/2004 Yatsuzuka et al.
2005/0257524 A1 * 11/2005 Yatsuzuka et al. ..... 60/670
2005/0257525 A1 11/2005 Komaki et al.

FOREIGN PATENT DOCUMENTS

JP 58-057014 4/1983
JP 2004-84523 3/2004
JP 2005-330910 12/2005

* cited by examiner

*Primary Examiner*—Hoang M Nguyen
(74) *Attorney, Agent, or Firm*—Harness, Dickey & Pierce, PLC

(57) ABSTRACT

In a steam engine 1, an inner wall face 22*a* of a connecting tube portion 22 is entirely formed out of a water repellent finish face 22*b*. Accordingly, when liquid located in a portion close to a heater 30 in a vertical direction extending tube 12 is heated, boiled and liquefied, a liquid level of the liquid in the vertical direction extending tube 12 is pushed down from a top dead center Lu to a bottom dead center Lb. At this time, a quantity of liquid drops attached onto the inner wall face 22*a* of the connecting tube portion 22 can be reduced as compared with a case in which the entire inner wall face 22*a* of the connecting tube portion 22 is not formed out of a water repellent finish face 22*b*.

12 Claims, 6 Drawing Sheets

STEAM ENGINE

BACKGROUND OF THE INVENTION

1. Technical Field of the Invention

The present invention relates to a steam engine composed in such a manner that a fluid displacement is generated in liquid charged in a tube when vaporization, which is caused by heating the liquid in the tube, and liquefaction, which is caused by cooling the liquid in the tube, are repeatedly carried out.

2. Description of the Related Art

A type of steam engine is conventionally known in which liquid charged in a container is vaporized by heating and liquefied by cooling so as to change the pressure in the container and mechanical energy can be outputted by the change in pressure. This technique is disclosed, for example, in the official gazette of Japanese Patent Unexamined Publication No. 58-57014.

On the other hand, the present applicant applied for patent of the technique of a steam engine having the following constitution. Concerning this technique, refer to Japanese Patent Unexamined Publication No. 2004-84523.

The constitution of this steam engine 500 is shown in FIG. 5.

The steam engine 500 includes: a tube 502 having a substantially U-shaped fluid passage into which liquid is charged; a heater 504 for heating the liquid in the tube 502; a cooler 506 for cooling vapor generated by vaporization of the liquid when it is heated by the heater 504; and an output portion 508.

The output portion 508 includes: a cylinder 510; a piston 512 capable of being reciprocated in the cylinder 510; a movable portion 514, one end portion of which is connected to the piston 512; and a spring member 516 arranged at the other end portion of the movable portion 514.

The piston 512 is reciprocated in the cylinder 510 according to the pressure given by the fluid in the tube 502. Specifically, the piston 512 is reciprocated between a lower end (bottom dead center), which is one end portion on the tube 502 side, and an upper end (top dead center) which is the other end portion on the opposite side to the inside of the tube 502.

In this steam engine 500, when the liquid in the tube 502 is heated by the heater 504 and boiled and vaporized, a volume of the fluid charged in the tube 502 is expanded. Next, the vapor, which has been vaporized being heated by the heater 504, is moved downward and cooled by the cooler 506 and liquefied. At this time, a volume of the fluid in the tube 502 is contracted. When a change in the liquid level (fluid displacement) is caused by the expansion and contraction of the volume of the fluid in the tube 502, the pressure of the fluid is changed and the piston 512 and the movable portion 514 are reciprocated by the change in pressure.

Accordingly, for example, when a permanent magnet is attached to the movable portion 514 and a coil is arranged being opposed to the permanent magnet, an electro-motive force is generated in the coil by the reciprocating motion conducted by the piston 512 and the movable portion 514.

Concerning the steam engine, the present applicant applied for patent of the technique disclosed in the official gazette of Japanese Patent Unexamined Publication No. 2005-330910.

In this connection, in the steam engine 500 shown in FIG. 5, the heater 504 and the cooler 506 are arranged on a tube line, which is formed by the tube 502, at an interval. This portion of the tube 502 corresponding to this interval will be referred to as a connecting tube portion 518 hereinafter, that is, a portion of the tube between the heater 504 and the cooler 506 will be referred to as a connecting tube portion 518 hereinafter.

In the conventional steam engine 500 having the above connecting pipe portion 518, the thermal efficiency is deteriorated.

Explanations are specifically made as follows. First, in this steam engine 500, as shown in FIG. 6, pressure Pm in the connecting pipe portion 518 is repeatedly increased and decreased with the lapse of time and this can be explained as follows.

In the steam engine 500, as the piston 512 is moved from the top dead center to the bottom dead center, a liquid level 520 (shown in FIG. 6) of the liquid piston made by the liquid in the tube 502 is raised from a position close to the cooler 506 to a position (top dead center Lu of the liquid level 520) close to the heater 504. When the piston 512 is moved from the top dead center to the bottom dead center, a volume of the fluid in the tube 502 is reduced. Therefore, as the liquid level 520 is raised, pressure Pm in the connecting pipe portion 518 is raised. Concerning this raise in the pressure, refer to pressure Pm between time t1 and time t2 shown in FIG. 6.

When the liquid level 520 is raised and reaches a height (top dead center Lu of the liquid level 520) of the heater 504 and the liquid close to the heater 504 is vaporized by the heater 504, the fluid volume in the tube 502 is changed being expanded. According to this expansion of the fluid volume, the piston 512 is moved from the bottom dead center to the top dead center. At this time, as shown in FIG. 6, the liquid level 520 is lowered from a position close to the heater 504 to a position (bottom dead center Lb of the liquid level 520) close to the lower end of the cooler 506. When the piston 512 is moved from the bottom dead center to the top dead center as described above, that is, when the liquid piston is moved from top dead center Lu to bottom dead center Lb, the liquid volume in the tube 502 is expanded. Therefore, as the liquid level 520 is lowered, pressure Pm in the connecting tube portion 518 is reduced. Concerning this reduction of pressure Pm, refer to pressure Pm in the period between time t2 and time t4 shown in FIG. 6.

When the liquid level 520 is lowered to the position (bottom dead center Lb of the liquid level 520) close to the lower end of the cooler 506 and vapor, which has been vaporized by the heater 504, exists in a region close to the cooler 506 in the pipe 502, vapor in a region located close to the cooler 506 is cooled by the cooler 506 and liquefied.

When the piston 512 is lowered and starts moving from the top dead center to the bottom dead center at the time of the reduction of pressure Pm, pressure Pm in the connecting tube portion 518 is raised again. When the piston 512 is lowered and the vapor is liquefied by the cooler 506, the liquid level 520 is raised from the position (bottom dead center Lb of the liquid level 520) close to the cooler 506 to the position (top dead center Lu of the liquid level 520) close to the heater 504. Concerning this matter, refer to pressure Pm in the period between time t4 and time t5 shown in FIG. 6.

In this connection, the connecting tube portion 518 is a portion of the tube 502 arranged between the heater 504 and the cooler 506 as described above. Accordingly, temperature Tm of the connecting portion 518 is influenced by the heater 504 and the cooler 506. Therefore, temperature Tm of the connecting portion 518 is a temperature between temperature Th of the heater 504 and temperature Tc of the cooler 506.

In this case, as shown in FIG. 6, pressure Pm in the connecting tube 518 can be changed to be higher or lower than the pressure of saturated vapor Pms of the fluid in the tube 502 at temperature Tm of the connecting tube portion 518.

Pressure Pm in the connecting tube portion 518 is reduced when the liquid level 520 is lowered as described above. In this case, for example, when the liquid level 520 is lowered to a position (bottom dead center Lb of the liquid level 520) close to the lower end of the cooler 506, liquid drops 522 attach onto an inner wall face 518*a* of the connecting tube portion 518. When pressure Pm in the connecting tube portion 518 is lower than saturated vapor pressure Pms at temperature Tm, the liquid drops 522 are vaporized. Concerning this matter, refer to a change in pressure Pm in the period between time t3 and time t4 shown in FIG. 6.

However, this vaporization of the liquid drops 522 is caused right before the liquid level 520 starts rising from bottom dead center Lb of the liquid level 520. Therefore, this vaporization of the liquid drops 522 seldom takes an action of further lowering the liquid level 520, that is, this vaporization of the liquid drops 522 seldom takes an action of expanding the fluid volume in the tube 502.

Nevertheless, vapor, which is generated when the liquid drops 522 are vaporized, is carried to a portion close to the cooler 506 and cooled by the cooler 506 and liquefied. This means that the vapor, which has been generated when the liquid drops 522 are vaporized, carries heat, which seldom contributes to the expansion of the liquid volume in the tube 502, and forces the cooler 506 to conduct a useless cooling action. Accordingly, in the steam engine 500, a great heat loss is caused by the vapor generated when the liquid drops 522 are vaporized.

SUMMARY OF THE INVENTION

An object of the present invention is to enhance the thermal efficiency of a steam engine in which a fluid displacement is generated in liquid in a tube when vaporization of the liquid charged into the tube by heating and liquefaction of the liquid charged into the tube by cooling are repeatedly carried out.

In order to accomplish the above object, a steam engine of the present invention includes: a tube into which liquid is charged; a heater for heating the liquid in the tube; and a cooler for cooling vapor which has vaporized when the liquid is heated by the heater.

In the steam engine of the present invention, a fluid displacement is generated by vaporization of liquid when the liquid is heated by a heater and by liquefaction of vapor when the vapor is cooled by a cooler.

In this case, the terminology "fluid displacement" is defined as a change in the liquid level generated by the expansion and contraction of the volume of fluid in a tube generated by vaporization of liquid when the liquid is heated by a heater and also generated by liquefaction of vapor when the vapor is cooled by a cooler.

In the steam engine of the present invention, the heater and the cooler are arranged on a tube line at an interval.

In the steam engine of the present invention, at least a portion of the inner wall face of the connecting tube portion arranged between the heater and the cooler may be formed out of a water repellent finish face. An embodiment in which at least a portion of the inner wall face of the connecting tube portion is formed out of a water repellent finish face is referred to as "a water repellent finish constitution" hereinafter.

In this case, the present invention can provide the following effects.

First, for example, it is estimated that not only a region close to the cooler in the tube and a region in the connecting tube portion but also a region close to the heater is filled with liquid. In the steam engine of the present invention, in this case, when the liquid in the tube is heated, boiled and vaporized by the heater, a volume of the fluid in the tube is expanded. Therefore, a liquid level of the liquid located at a position close to the heater in the tube is moved to the cooler side through the connecting tube portion.

In the case where the water repellent finish constitution is adopted in the present invention, a quantity of liquid drops, which are attached onto the inner wall face of the connecting tube portion when the liquid level of liquid is moved onto the cooler side through the connecting tube portion, can be reduced as compared with a quantity of liquid drops in the case where the entire inner wall face of the connecting tube portion are not formed out of a water repellent finish face.

In the steam engine of this case, a quantity of liquid drops attached to the connecting tube portion after the movement of the liquid level is reduced as described above. Accordingly, a quantity of liquid drops attached to the connecting tube portion, which is vaporized after the movement of the liquid level of the liquid in the tube onto the cooler side when the pressure in the tube becomes lower than the saturated vapor pressure at the temperature of the connecting tube portion, can be reduced.

According to the steam engine of the present invention, a quantity of liquid drops, which are attached to the connecting tube portion after the liquid level has been moved, can be reduced. By the reduction of the quantity of liquid drops, it is possible to suppress the occurrence of a phenomenon in which the useless heat not contributing to the expansion of the fluid volume in the tube is carried to a neighborhood of the cooler by the vapor. According to the steam engine in this case, the thermal efficiency can be enhanced by this suppression.

In the present invention, in the case where the water repellent finish constitution is adopted as described above, the entire inner wall face of the connecting tube portion may be composed of a water repellent finish face.

In this case, compared with a case in which only a portion of the inner wall face of the connecting tube portion is formed out of a water repellent finish face, a quantity of liquid drops, which are attached to the connecting tube portion after the liquid level has been removed, can be further reduced.

Accordingly, in this case, when the pressure in the tube after the liquid level of the liquid in the tube has moved onto the cooler side becomes lower than the saturated vapor pressure at the temperature of the connecting tube portion, vaporization is caused. A quantity of liquid drops, which are attached to the connecting tube portion after the liquid level has moved, can be further reduced as compared with a case in which only a portion of the inner wall face of the connecting tube portion is formed out of a water repellent finish face.

In this case, a quantity of liquid drops to be vaporized, which are attached to the connecting tube portion after the liquid level has moved, can be further reduced. According to this reduction in the quantity of liquid drops to be vaporized, the thermal efficiency of the steam engine can be further enhanced.

In this connection, the water repellent finish face of the inner wall face of the connecting tube portion may be a mirror finish face. Alternatively, the water repellent finish face of the inner wall face of the connecting tube portion may be a face coated with a predetermined material.

On the other hand, in the steam engine of the present invention, the heater may be composed in such a manner that the heater is arranged adjacent to a portion of the tube so that the liquid inside the portion of the tube can be heated.

In the steam engine of this case, the wall thickness of the tube in at least a portion of the connecting tube portion may be smaller than the wall thickness of a portion of the tube adjacent to the heater. "A portion of the tube adjacent to the heater" is referred to as "a heater adjacent tube portion" hereinafter. This embodiment, in which the wall thickness of the tube in at least a portion of the connecting tube portion is smaller than the wall thickness of the heater adjacent tube portion, will be referred to as "a wall thickness reducing constitution" hereinafter.

In this case, for example, as compared with a case in which the wall thickness of the heater adjacent tube portion is made to agree with the wall thickness of the connecting tube portion, a quantity of heat transmitted from the heater to the connecting tube portion through the heater adjacent tube portion or the outside air can be reduced.

The reason is described as follows. The wall thickness of at least a portion of the connecting tube portion is reduced as described above. According to this reduction of the wall thickness, a volume (heat capacity) of the connecting tube portion is lowered and a quantity of total heat, which is capable of flowing into the connecting tube portion from the heater through the heater adjacent tube portion or the outside air, is reduced.

In the steam engine of this case, a quantity of total heat transmitted from the heater to the connecting tube portion can be reduced as described above. According to this reduction of the quantity of total heat, a quantity of total heat transmitted from the connecting tube portion to the fluid in the connecting tube portion can be reduced. As a result, according to the reduction of the quantity of total heat, the quantity of liquid drops to be vaporized, which are attached to the connecting tube portion after the liquid level has moved, can be reduced.

Accordingly, in the steam engine of this case, a quantity of liquid drops to be vaporized can be reduced. According to this reduction of the quantity of liquid drops to be vaporized, as compared with a conventional case, it is possible to suppress the occurrence of a phenomenon in which the useless heat not contributing to the expansion of the volume of the fluid in the tube is carried to a neighborhood of the cooler. According to this suppression of the occurrence of the phenomenon, the thermal efficiency can be enhanced.

In the present invention, when the wall thickness reducing constitution is adopted as described before, the thickness of the wall thickness of the entire connecting tube portion may be smaller than the wall thickness of the heater adjacent tube portion.

Due to the foregoing, as compared with a case in which the wall thickness of a portion of the connecting tube portion is reduced to be smaller than the wall thickness of the heater adjacent tube portion, a quantity of total heat transmitted from the heater to the connecting tube portion through the heater adjacent tube portion or the outside air can be further reduced.

Consequently, in this case, the quantity of total heat transmitted from the heater to the connecting tube portion can be further reduced. According to this reduction of the quantity of total heat, a quantity of total heat transmitted from the connecting tube portion to the fluid in the connecting tube portion can be further reduced. As a result, a quantity of liquid drops to be vaporized attached to the connecting tube portion after the movement of the liquid level can be further reduced. According to the reduction of the quantity of liquid drops to be vaporized attached to the connecting tube portion after the movement of the liquid level, the thermal efficiency of the steam engine can be further enhanced.

On the other hand, in the case where it is composed in such a manner that the liquid in the heater adjacent tube portion is heated when the heater is provided being adjacent to the heater adjacent tube portion, the connecting tube portion may be composed of a connecting tube member which is separate from the heater adjacent tube portion.

In the steam engine of this case, when the connecting tube portion member and the heater adjacent tube portion tube member are joined to each other, the connecting tube portion member and the heater adjacent tube portion tube member may be formed into a continuous portion in the tube. This embodiment, in which the connecting tube portion member and the heater adjacent tube portion tube member, which are separate from each other, are joined to each other, is referred to as "a separate tube joining constitution".

In this case, as compared with a case in which the connecting tube portion member and the heater adjacent tube portion tube member are composed as a portion in the tube member which is integrally formed having no joint portion, it is possible to reduce a quantity of total heat transmitted from the heater to the connecting tube portion through the heater adjacent tube portion.

In the case where the connecting tube portion member and the heater adjacent tube portion tube member are joined to each other, a seam is made between both members. In the case where the seam is made between both members, the efficiency of heat transmission from the heater adjacent tube portion to the connecting tube portion member is deteriorated as compared with a case in which no seam is made.

In the steam engine of this case, the efficiency of heat transmission from the heater adjacent tube portion to the connecting tube portion member is deteriorated as described above. Accordingly, a quantity of total heat transmitted from the heater (the heater adjacent tube portion) to the connecting tube portion member can be reduced. As a result, according to the reduction of the quantity of total heat, it is possible to reduce a quantity of liquid drops to be vaporized attached to the connecting tube portion after the movement of the liquid level can be reduced.

Accordingly, in the steam engine of this case, a quantity of liquid drops to be vaporized can be reduced. According to this reduction of the quantity of liquid drops to be vaporized, it is possible to suppress the occurrence of a phenomenon in which the useless heat not contributing to the expansion of the volume of the fluid in the tube is carried to a neighborhood of the cooler. According to this suppression of the occurrence of the phenomenon, the thermal efficiency can be enhanced.

In the present invention, in the case where the separate tube joining constitution is adopted as described above, materials of the connecting tube member and the heater adjacent tube portion tube member may be selected so that the heat conductivity of the material of the connecting tube member can be lower than the heat conductivity of the material of the heater adjacent tube portion tube member.

Due to the foregoing, as compared with a case in which the heat conductivity of the material of the connecting tube member is the same as the heat conductivity of the material of the heater adjacent tube portion tube member (for example, as compared with a case in which the material of the connecting tube member is the same as the material of the heater adjacent tube portion tube member), it is possible to further reduce a quantity of total heat transmitted from the heater (the heater adjacent tube portion) to the connecting tube portion.

Consequently, in this case, a quantity of total heat transmitted from the heater (the heater adjacent tube portion) to the connecting tube portion can be further reduced.

According to this reduction of the quantity of total heat, the quantity of liquid drops to be vaporized and attached to the connecting tube portion after the movement of the liquid level, can be further reduced.

According to the reduction of the quantity of liquid drops to be vaporized attached to the connecting tube portion after the movement of the liquid level, the thermal efficiency of the steam engine can be further enhanced.

On the other hand, in the steam engine of the present invention, a fluidity direction of the liquid in the connecting tube portion, which will be referred to as "a connecting tube portion fluidity direction" hereinafter, and a fluidity direction of the liquid in the tube portion in which the heater is provided, which will be referred to as "a heater tube portion fluidity direction" hereinafter, may be different from each other.

In the steam engine of this case, a gap may be formed between the heater and the connecting tube portion. This embodiment, in which the gap is formed between the heater and the connecting tube portion in the case where the fluidity direction of the liquid in the connecting tube portion and the fluidity direction of the liquid in the tube portion in which the heater is provided are different from each other, is referred to as "a gap arrangement constitution" hereinafter.

Due to the foregoing, as compared with a case in which the heater comes into contact with the connecting tube portion corresponding to a case in which the connecting tube portion fluidity direction and the heater tube portion fluidity direction are made to be different from each other, for example, a tube is bent in a portion between the portion, in which the heater is provided, and a connecting tube portion, since the heater and the connecting tube portion are separate from each other, the efficiency of heat transmission from the heater to the connecting tube portion is lowered.

In this steam engine, the efficiency of heat transmission from the heater to the connecting tube portion is lowered as described above, it is possible to reduce a quantity of total heat transmitted from the heater to the connecting tube portion. Therefore, it is possible to reduce a quantity of total heat transmitted from the connecting tube portion to the fluid in the connecting tube portion. As a result, it is possible to reduce a quantity of liquid drops attached to the connecting tube portion after the movement of the liquid level.

Accordingly, in the steam engine of this case, in the case where the connecting tube fluidity direction and the heater tube portion fluidity direction are different from each other, a quantity of liquid drops to be vaporized can be reduced. According to the reduction of the quantity of liquid drops to be vaporized, it is possible to suppress the occurrence of a phenomenon in which the useless heat not contributing to the expansion of the fluid volume in the tube is carried, in a neighborhood of the cooler, by the vapor. According to the steam engine in this case, the thermal efficiency can be enhanced by this suppression.

In the present invention, in the case where the gap arrangement constitution is adopted as described above, a heat insulating material may be arranged in the gap between the heater and the connecting tube portion.

Due to the foregoing, as compared with a case in which the heater comes into contact with the connecting tube portion corresponding to the structure in which the connecting tube fluidity direction and the heater tube portion fluidity direction are different from each other, since the heat insulating material is interposed between the heater and the connecting tube portion, the efficiency of heat transmission from the heater to the connecting tube portion is lowered.

In this case, according to the reduction of the heat transmission efficiency, it is possible to reduce the quantity of liquid drops to be vaporized attached to the connecting tube portion after the movement of the liquid level.

Accordingly, in this case, according to the reduction of the quantity of liquid drops to be vaporized attached to the connecting tube portion after the movement of the liquid level, the thermal efficiency of the steam engine can be enhanced.

In this connection, concerning the aforementioned gap formed between the heater and the connecting tube portion, various type gaps are considered. For example, it is possible to adopt a structure in which the gap concerned is formed when a protruding portion is formed in a portion of the heater.

On the other hand, in addition to the above structure, the steam engine of the present invention may include an output portion by which mechanical energy can be obtained from a fluid displacement which is generated in the liquid in the tube by the vaporization of the liquid in the heater and by the liquefaction of the vapor in the cooler.

Due to the foregoing, a fluid displacement generated in the tube can be changed into mechanical energy so that it can be preferably used.

In the steam engine of the present invention, the heater may be located in an upper portion of the cooler.

In this case, for example, when gravity acting on the liquid in the tube is utilized, the change in the liquid level described before can be preferably facilitated.

Concerning the position at which the heater is located higher than the cooler, the heater is located at an upper position perpendicular to the cooler. Further, it can be considered that the heater is located at an upper position obliquely perpendicular to the cooler.

In the steam engine of the present invention, as long as it is composed in such a manner that the liquid level is moved, that is, the fluid displacement is caused, a positional relation between the heater and the cooler is not limited to the aforementioned positional relation, that is, other positional relations may be adopted. For example, the heater and the cooler may be located at the substantially same height.

The steam engine of the present invention may include one of the water repellent finish constitution, the wall thickness reducing constitution, the separate pipe joining constitution and the gap arranging constitution. Further, the steam engine of the present invention may include two or more constitutions at the same time.

The present invention may be more fully understood from the description of preferred embodiments of the invention, as set forth below, together with the accompanying drawings.

DESCRIPTION OF THE PREFERRED EMBODIMENTS

Referring to the accompanying drawings, embodiments to which the present invention is applied will be explained below. In this connection, it should be noted that the present invention is not limited to the specific embodiments described below. As long as it belongs to the technical scope of the present invention, various embodiments may be adopted.

Embodiment 1

Explanation of the Constitution of Steam Engine 1

Figure 1:
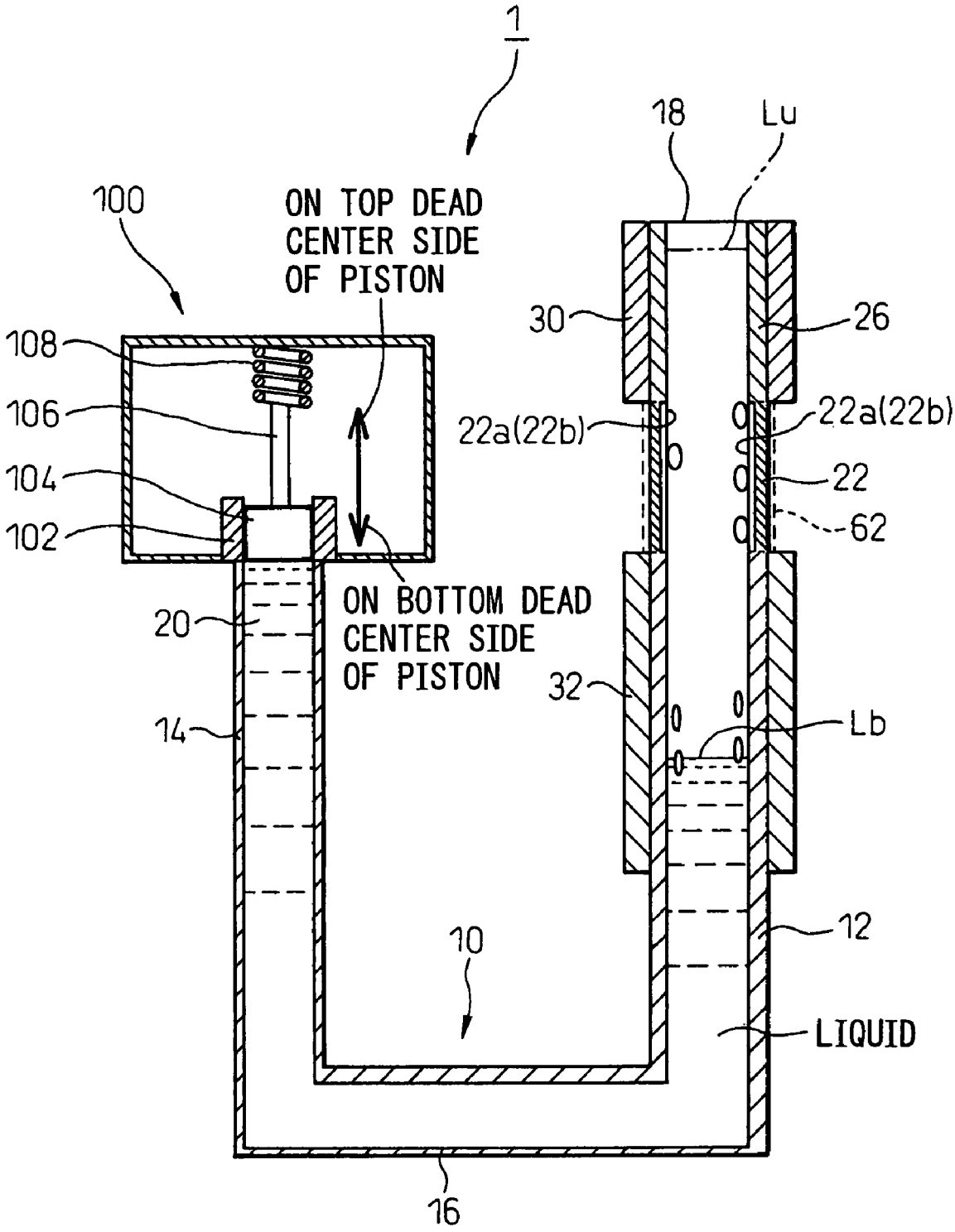
FIG. 1 is a view showing an outline of the constitution of the steam engine of Embodiment 1.

FIG. 1 is a view showing an outline of the constitution of the steam engine 1 of Embodiment 1.

As shown in FIG. 1, the steam engine 1 includes: a tube 10 into which liquid such as water is charged with a predetermined pressure; a heater 30; a cooler 32; and an output portion 100.

The tube 10 is formed into a pipe-shaped container, which is formed into a substantially U-shape, including: two extending tubes 12, 14 which are extended in the vertical direction; and an extending tube 16, which is extended in the lateral direction, for connecting lower portions of the two extending tubes 12, 14 which are extended in the vertical direction.

In the present embodiment, the heater 30, the cooler 32 and the output portion 100 are arranged on the tube line composed of the tube 10 in this order. The heater 30 and the cooler 32 are arranged at an interval on the tube line composed of the tube 10. A portion of the tube 10 (a portion between the heater 30 and the cooler 32 of the tube 10) corresponding to this interval will be referred to as a connecting tube portion 22 hereinafter.

The heater 30 is used for partially heating the liquid in the tube 10 so as to vaporize the liquid. For example, the heater 30 is formed out of a heat exchanger for heating. The cooler 32 is used for cooling the vapor, which is generated when the liquid is vaporized by an action of the heater 30, so that the vapor can be liquefied. For example, the cooler 32 is formed out of a heat exchanger for cooling.

The heater 30 is provided being adjacent to an outer face of the vertical direction extending tube 12 in a neighborhood of the upper end portion 18 of the vertical direction extending tube 12. The heater 30 heats the liquid in the vertical direction extending tube 12 through the vertical direction extending tube 12. In this connection, a portion of the vertical direction extending tube 12, which is adjacent to the heater 30, will be referred to as a heater adjacent tube portion 26.

The cooler 32 is provided at a position on an outer face of the vertical direction extending tube 12 lower than the heater 30 being adjacent to the heater 30. The cooler 32 cools the inside of the vertical direction extending tube 12 through the vertical direction extending tube 12.

The output portion 100 includes: a cylinder 102 which is arranged so that it can be communicated with the upper end portion 20 of the vertical direction extending tube 14; a piston 104 capable of reciprocating in the cylinder 102; a movable portion 106, one end of which is connected to the piston 104; and a spring member 108 arranged at the other end portion of the movable portion 106.

In this output portion 100, a permanent magnet (not shown) is attached to the movable portion 106. At a position opposed to the permanent magnet, a coil (not shown) is arranged.

The piston 104 and the movable portion 106 are linearly reciprocated when a change in the liquid level, which is generated in the upper end portion 20 of the vertical direction extending tube 14, is received as a change in the pressure. At the time of this reciprocating motion, while the piston 104 is facing the liquid in the tube 10, it is reciprocated between a lower end (bottom dead center), which is one end on the tube 10 side, and an upper end (top dead center) which is the other end on the opposite side to the tube 10 side.

In the output portion 100, an electro-motive force is generated according to this reciprocating motion. As a result, electric power is generated.

In the present embodiment, the entire inner wall face 22*a* of the connecting tube portion 22 is formed out of a water repellent finish face 22*b*. For example, specific embodiments of the water repellent finish face 22*b* are described as follows.

(1) When mirror face finish processing is conducted on the inner wall face 22*a* of the connecting tube portion 22, the water repellent finish face 22*b* is obtained.

(2) When the inner wall face 22*a* of the connecting tube portion 22 is coated with a predetermined material, the water repellent finish face 22*b* is obtained. Specifically, when a fluorine coating agent such as PTFE: polytetrafluoroethyene (Teflon™) or silicon resin is coated on the inner wall face 22*a* of the connecting tube portion 22 composed of a metallic tube, the water repellent finish face 22*b* may be formed. In this case, after fine irregularities have been made on the inner wall face 22*a* of the connecting tube portion 22 by the method of anode oxidation or sand-blast, the inner wall face 22*a* is coated with a fluorine coating agent or silicon resin so that the water repellent finish face 22*b* can be formed. Alternatively, when fluoridized fine particles (PTFE: polytetrafluoroethylene, Teflon® are attached onto the inner wall face 22*a* of the connecting tube portion 22 by the method of disperse plating so that the water repellent finish face 22*b* can be formed.

(3) In order to relatively increase the surface area density of the inner wall face 22*a* of the connecting tube portion 22, when the inner wall face 22*a* is formed into an irregular surface on which irregularities are formed, the water repellent finish face 22*b* is obtained. In this case, it is preferable that irregularities are formed on the inner wall face 22*a* so that the surface area density of the inner wall face 22*a* of the connecting tube portion 22 can be higher than the surface area density of the inner wall face of the heater adjacent tube portion 26. In this connection, the terminology of the surface area density is defined as an inner wall surface area included in the unit volume of the connecting tube portion 22 (or the heater adjacent tube portion 26). In other words, the surface area density of the inner wall face 22*a* of the connecting tube portion 22 is a value obtained when the surface area of the entire inner wall face 22*a* of the connecting tube portion 22 is divided by the volume of the entire connecting tube portion 22. The surface area density of the inner wall face of the heater adjacent tube portion 26 is a value obtained when the surface area of the entire inner wall face of the heater adjacent tube portion 26 is divided by the volume of the entire heater adjacent tube portion 26.

(4) When a large number of needle-shaped protrusions, the tips of which are sharp, are formed on the inner wall face 22*a* of the connecting tube portion 22, the inner wall face 22*a* concerned can be formed into an irregular surface. In this way, the water repellent finish surface 22*b* is obtained. In this case, it is preferable that the protruding length of the protrusion formed on the inner wall surface 22*b* is in a range from several tens of nm to several hundreds of μm.

Explanation of Operation of Steam Engine 1

The steam engine 1 of the present embodiment composed as described above is driven when the heater 30 and the cooler 32 are operated.

Specifically, operation is conducted as follows. When the liquid in the vertical direction extending tube 12 fills a neighborhood of the cooler 32 in the vertical direction extending tube 12 and also fills a region from the connecting tube portion 22 to a neighborhood of the heater 30 and when a liquid level of the liquid concerned is located at the top dead center Lu in the neighborhood of the heater 30 in the vertical direction extending tube 12, the liquid located in the neighborhood of the heater 30 in the vertical direction extending tube 30 is heated, boiled and vaporized.

Due to this boiling and vaporization, a volume of the fluid in the tube 10 is expanded. Specifically, due to this boiling and vaporization, vapor of high temperature and pressure is accumulated in an upper portion in the vertical direction extending tube 12. Therefore, a liquid level of the liquid in the vertical direction extending tube 12 is pushed down to the bottom dead center Lb in the neighborhood of the cooler 32.

Then, a liquid piston made of the liquid in the tube 10 is displaced from the inside of the vertical direction extending tube 12 to the inside of the vertical direction extending tube 14. Therefore, the piston 104 in the output portion 100 is pushed up to the top dead center side.

Next, when the liquid level of the liquid in the vertical direction extending tube 12 is located at the bottom dead center Lb and the vapor, which has been vaporized by the heater 30, exists in a region close to the cooler 32 in the vertical direction extending tube 12, the vapor concerned located in the region close to the cooler 32 is cooled by the cooler 32 and liquefied.

At this time, a volume of the fluid in the tube 10 is contracted. Specifically, when the vapor accumulated in the vertical direction extending tube 12 is liquefied, the liquid piston made of the liquid in the tube 10 flows and is displaced from the inside of the vertical direction extending tube 14 to the inside of the vertical direction extending tube 12. Accordingly, the piston 104 of the output portion 100 is lowered onto the bottom dead center side.

In the steam engine 1 of the present embodiment, when the above fluid displacement is repeatedly generated, the piston 104 and the movable portion 106 are continuously reciprocated. Due to the foregoing, electric power is generated.

Explanation of Action and Effect of Steam Engine 1

In the steam engine 1 of the present embodiment, as described before, the entire inner wall face 22*a* of the connecting portion 22 is formed out of a water repellent finish face 22*b*.

According to the present embodiment, as described above, when the liquid located in the neighborhood of the heater 30 in the vertical direction extending tube 12 is heated, boiled and vaporized, a quantity of liquid drops, which are attached onto the inner wall face 22 of the connecting tube portion 22 when the liquid level of the liquid in the vertical direction extending tube 12 is pushed down from the top dead center Lu to the bottom dead center Lb according to the boil and vaporization of the liquid, can be reduced as compared with a case in which the entire inner wall face 22*a* of the connecting tube portion 22 is not formed out of the water repellent finish face 22*b*. The above liquid drops will be referred to as "liquid drops attached to the connecting tube portion after the liquid level is moved" hereinafter.

In the steam engine 1 of the present embodiment, the quantity of liquid drops attached to the connecting tube portion after the liquid level is moved can be reduced. According to this reduction of the quantity of liquid drops, it is possible to reduce a quantity of liquid drops, which are attached to the connecting tube portion after the movement of the liquid face, to be vaporized when the pressure in the tube 10 becomes lower than the saturated vapor pressure at the temperature of the connecting tube portion 22 after the liquid level of the liquid in the vertical direction extending tube 12 has been pushed down from the top dead center Lu to the bottom dead center Lb.

Therefore, according to the steam engine 1 of the present embodiment, a quantity of liquid drops attached to the connecting tube portion after the liquid level has been moved, can be reduced. By the reduction of the quantity of liquid drops, it is possible to suppress the occurrence of a phenomenon in which the useless heat not contributing to the expansion of the fluid volume in the tube 10 is carried to a neighborhood of the cooler 32 by the vapor. According to the steam engine 1 in this embodiment, the thermal efficiency can be enhanced by this suppression.

In this connection, in the present embodiment, the entire inner wall face 22*a* of the connecting tube portion 22 is formed out of a water repellent finish face 22*b*. However, a portion of the inner wall face 22*a* of the connecting tube portion 22 may be formed out of a water repellent finish face 22*b*.

In this case, a portion of the inner wall face 22*a* is formed out of a water repellent finish face 22*b*. Accordingly, as compared with a case in which the inner wall face 22*a* of the connecting tube portion 22 is not entirely formed out of the water repellent finish face 22*b*, the quantity of liquid drops, which are attached to the connecting tube portion after the liquid level has been moved, can be further reduced.

Since the quantity of liquid drops, which are attached to the connecting tube portion after the liquid level has been moved, can be further reduced as described above, a quantity of liquid drops to be vaporized can be reduced as compared with a conventional case. According to the reduction of the quantity of liquid drops to be vaporized, the thermal efficiency of the steam engine 1 can be enhanced.

Embodiment 2

Next, Embodiment 2 will be explained below.

In this connection, explanations of the same portions as those of Embodiment 1 described before are omitted or simplified here.

Figure 2:
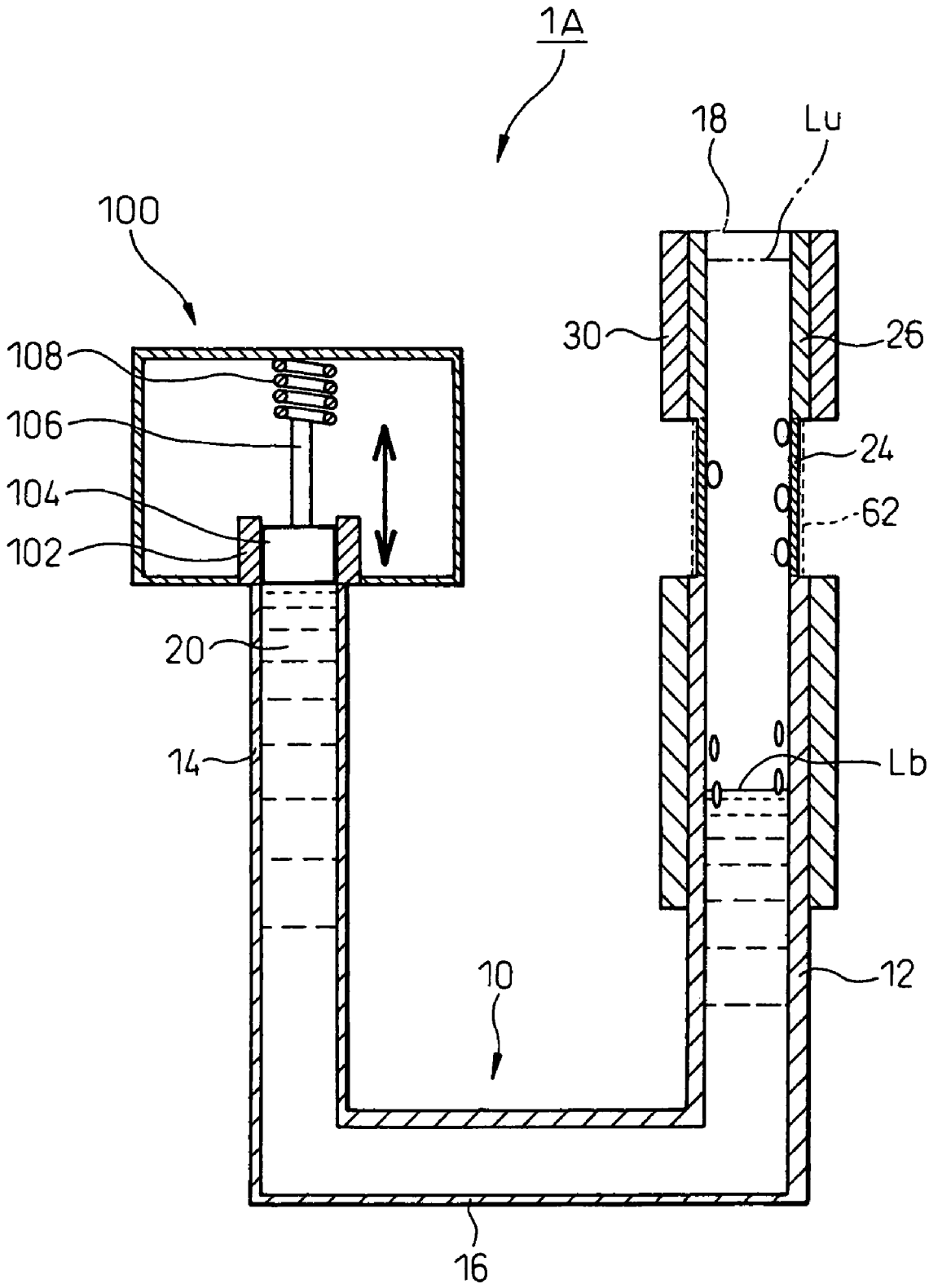
FIG. 2 is a view showing an outline of the constitution of the steam engine of Embodiment 2.

FIG. 2 is a view showing an outline of the constitution of the steam engine 1A of Embodiment 2.

A point of the present embodiment (Embodiment 2) different from that of Embodiment 1 described before is that only the connecting tube portion 22 is replaced with the connecting tube portion 24.

In the present embodiment, as compared with the wall thickness of a portion (a heater adjacent tube portion) of the vertical direction extending tube 12 adjacent to the heater 30, the wall thickness of the entire connecting tube portion 24 is reduced.

Therefore, according to the steam engine 1A of Embodiment 2, as compared with a case in which the wall thickness of the heater adjacent tube portion 26 is made to agree with the wall thickness of the connecting tube portion 24, a quantity of total heat transmitted from the heater 30 to the connecting tube portion 24 through the heater adjacent tube portion 26 or the outside air can be reduced.

In the present embodiment, a quantity of total heat transmitted from the heater 30 to the connecting tube portion 24 can be reduced as described above. According to this reduction of the quantity of total heat to be transmitted, a quantity of total heat transmitted from the connecting tube portion 24 to the fluid in the connecting tube portion 24 can be reduced. As a result, according to the reduction of the quantity of total heat, a quantity of liquid drops to be vaporized, which are attached to the connecting tube portion after the liquid level has moved, can be reduced.

Accordingly, in the steam engine of this case, a quantity of liquid drops to be vaporized attached to the connecting tube portion after the movement of the liquid level can be reduced. According to this reduction of the quantity of liquid drops to be vaporized, as compared with a conventional case, it is possible to suppress the occurrence of a phenomenon in which the useless heat not contributing to the expansion of the volume of the fluid in the tube 10 is carried to a neighborhood of the cooler 32. According to this suppression of the occurrence of the phenomenon, the thermal efficiency can be enhanced.

In the present embodiment, the wall thickness of the entire connecting tube portion 24 is reduced to be smaller than the wall thickness of the heater adjacent tube portion 26. However, the wall thickness of only a portion of the connecting tube portion 24 may be smaller than the wall thickness of the heater adjacent tube portion 26.

In this case, the wall thickness of a portion of the connecting tube portion 24 is reduced to be smaller than the wall thickness of the heater adjacent tube portion 26. According to this reduction of the wall thickness, a quantity of total heat transmitted from the heater 30 to the connecting tube portion 24 through the heater adjacent tube portion 26 or the outside air can be further reduced.

As described above, the quantity of total heat can be reduced. Accordingly, a quantity of total heat transmitted from the connecting tube portion 24 to the fluid flowing in the connecting tube portion 24 can be reduced. According to this reduction of the quantity of total heat the thermal efficiency of the steam engine 1A can be enhanced.

Embodiment 3

Next, Embodiment 3 will be explained below.

In this connection, explanations of the same portions as those of Embodiment 1 described before are omitted or simplified here.

Figure 3:
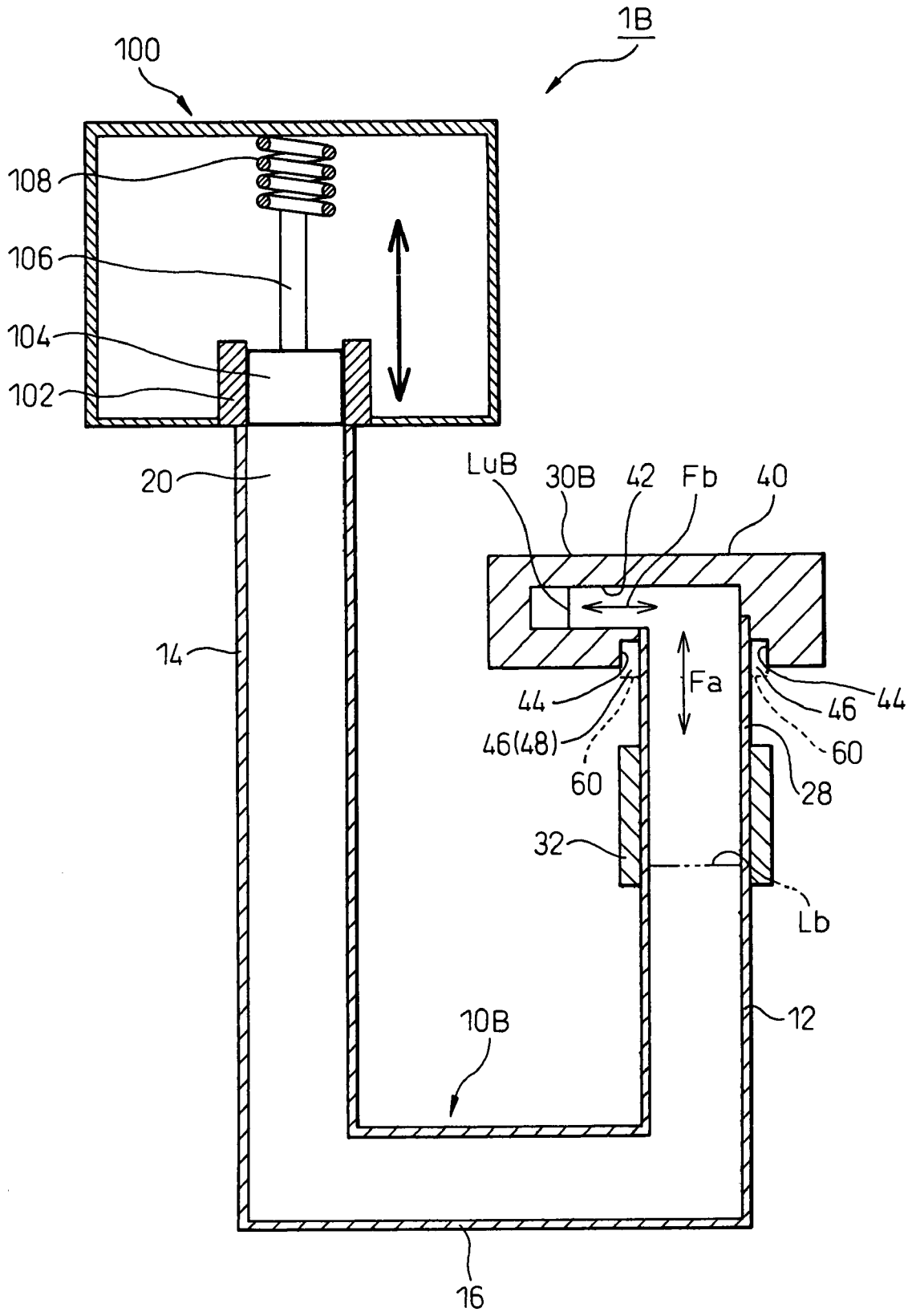
FIG. 3 is a view showing an outline of the constitution of the steam engine of Embodiment 3.

FIG. 3 is a view showing an outline of the constitution of the steam engine 1B of Embodiment 3.

A point of the present embodiment (Embodiment 3) different from that of Embodiment 1 described before is described as follows.

The tube 10B of the steam engine 1B includes a different direction extending tube 40 having an inner wall face 42, which extends in one direction different from the extending direction of the vertical direction extending tube 12, wherein this different direction extending tube 40 is provided at an upper end portion of the vertical direction extending tube 12. The steam engine of the present embodiment is different from the steam engine 1 of Embodiment 1 at the point described above. In the present embodiment, an outer face portion of the different direction extending tube 40 is composed as a heater 30B for heating and vaporizing the liquid in the different direction extending tube 40 through the different direction extending tube 40.

The present embodiment is different from Embodiment 1 at the point that the connecting tube portion 22 is replaced with the connecting tube portion 28. An inner wall face of the connecting tube portion 28 is different from the inner wall face 22*a* of the connecting tube portion 22 of Embodiment 1 in such a manner that the inner wall face of the connecting tube portion 28 is not formed out of a water repellent finish face. However, the inner wall face of the connecting tube portion 28 may be formed out of a water repellent finish face in the same manner as that of the inner wall face 22*a* of the connecting tube portion 22 of Embodiment 1.

An extending direction of the inner wall face 42 of the different direction extending tube 40 is not limited to a specific direction. In the present embodiment, the inner wall face 42 of the different direction extending tube 40 extends to a side (to the left in FIG. 3) with respect to the inner wall face of the vertical direction extending tube 12 which extends in the vertical direction.

Accordingly, in the steam engine 1B of the present embodiment, a liquid flowing direction Fa, which will be referred to as "a connecting tube portion flowing direction" hereinafter, inside the connecting tube portion 28 is different from a liquid flowing direction Fb, which will be referred to as "a heater tube portion flowing direction" hereinafter, inside a portion (the different direction extending tube 40) of the tube 10B in which the heater 30B is provided. In this connection, the present embodiment is composed in such a manner that a portion corresponding to the top dead center Lu of Embodiment 1 is the top dead center LuB in the different direction extending tube 40.

Further, at an end portion of the different direction extending tube 40, which also functions as a heater 30B, on the connecting tube portion 28 side, a recess portion 44 is provided. Therefore, between the heater 30B (the different direction extending tube 40) and the connecting tube portion 28, a gap 46 is formed which is made by the recess portion 44.

In the case where the connecting tube portion flowing direction and the heater tube portion flowing direction are different from each other like the present embodiment, the heater 30B (the different direction extending tube 40) and the connecting tube portion 28 usually come into contact with each other at a bending direction side edge portion of the tube 10B. In the present embodiment, the bending direction side edge portion of the tube 10B is a left edge portion of the boundary portion between the heater 30B (the different direction extending tube 40) and the connecting tube portion 28.

However, in the present embodiment, the gap 46 exists between the end portion of the heater 30B (the different direction extending tube 40), which includes a portion corresponding to the bending direction side edge portion 48, and the connecting tube portion 28.

Therefore, according to the steam engine 1B of the present embodiment, as compared with a case in which the heater 30B (the different direction extending tube 40) and the connecting tube portion 28 come into contact with each other, the efficiency of heat transmission from the heater 30B (the different direction extending tube 40) to the connecting tube portion 28 is lowered because the heater 30B (the different direction extending tube 40) and the connecting tube portion 28 are separate from each other.

In the steam engine 1B, the efficiency of heat transmission from the heater 30B (the different direction extending tube 40) to the connecting tube portion 28 is lowered as described above. Therefore, a quantity of total heat transmitted from the heater 30B (the different direction extending tube 40) to the fluid in the connecting tube portion 28 can be reduced.

As a result, according to the steam engine 1B, as compared with a case in which the heater 30B (the different direction extending tube 40) and the connecting tube portion 28 come into contact with each other, the quantity of liquid drops to be vaporized attached to the connecting tube portion after the movement of the liquid level can be reduced.

In the steam engine 1B of the present embodiment, the quantity of liquid drops to be vaporized attached to the connecting tube portion after the movement of the liquid level can be reduced. According to the reduction of the quantity of liquid drops to be vaporized, it is possible to suppress the occurrence of a phenomenon in which the useless heat not contributing to the expansion of the fluid volume in the tube 10B is carried to a neighborhood of the cooler 32 by the vapor. The thermal efficiency can be enhanced by this suppression.

In this connection, in Embodiment 3, the extending direction of the inner wall face of the different direction extending tube 40 is one direction which is different from the extending direction of the vertical direction extending tube 12. However, the extending direction of the inner wall face of the different direction extending tube 40 may be a plurality of directions different from the extending direction of the vertical direction extending tube 12.

Figure 4:
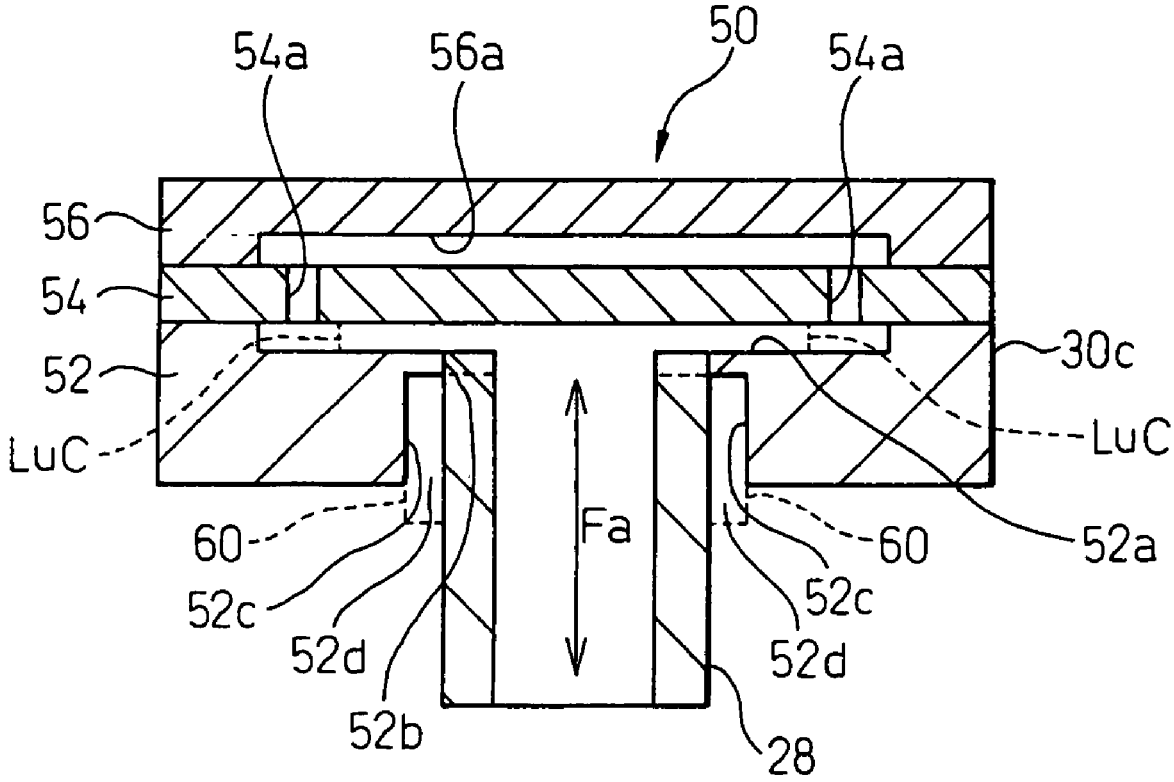
FIG. 4 is a view showing an outline of the constitution in the periphery of the different direction extending tube of the steam engine of a variation of Embodiment 3.
Figure 5:
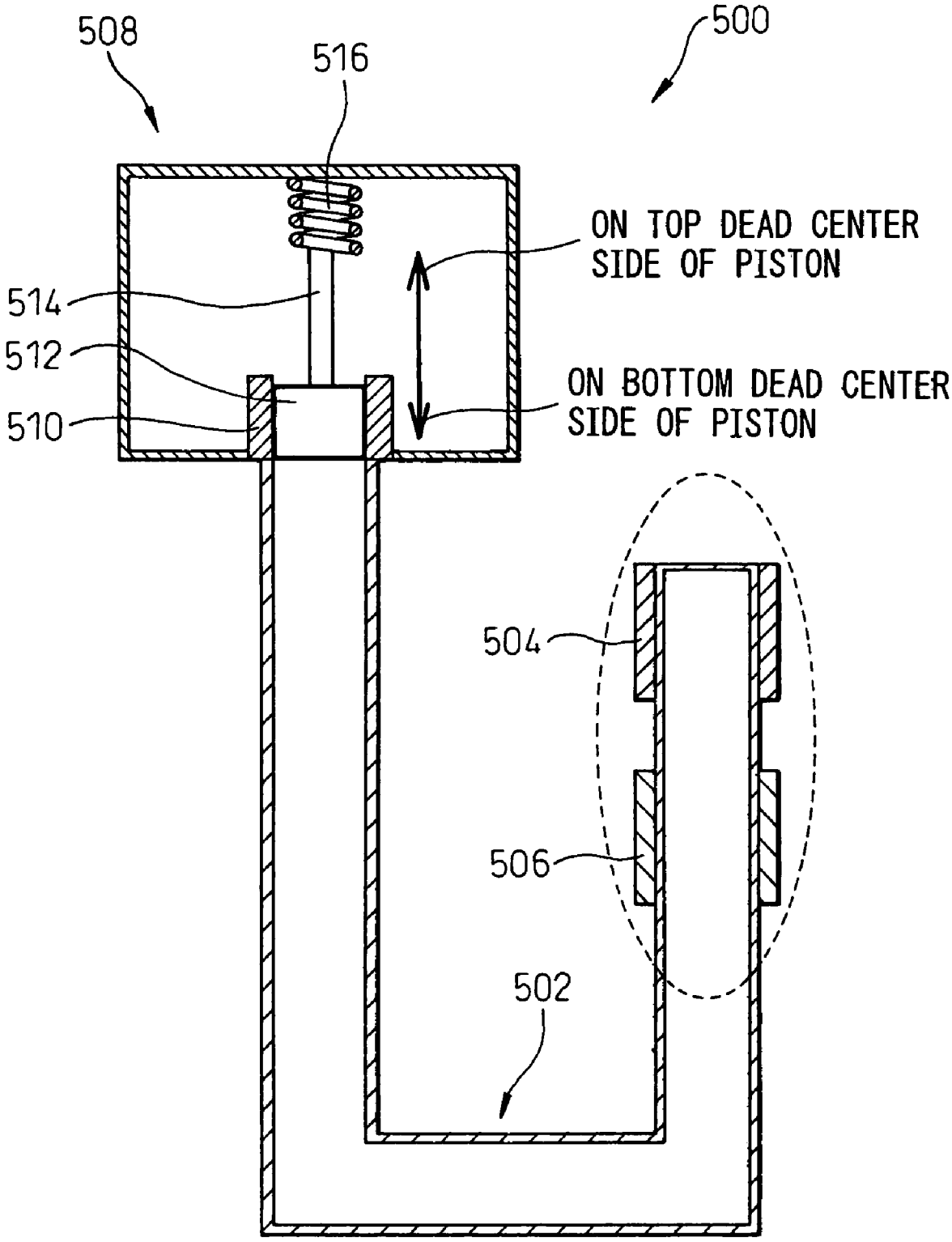
FIG. 5 is a view showing an outline of the constitution of the conventional steam engine.
Figure 6:
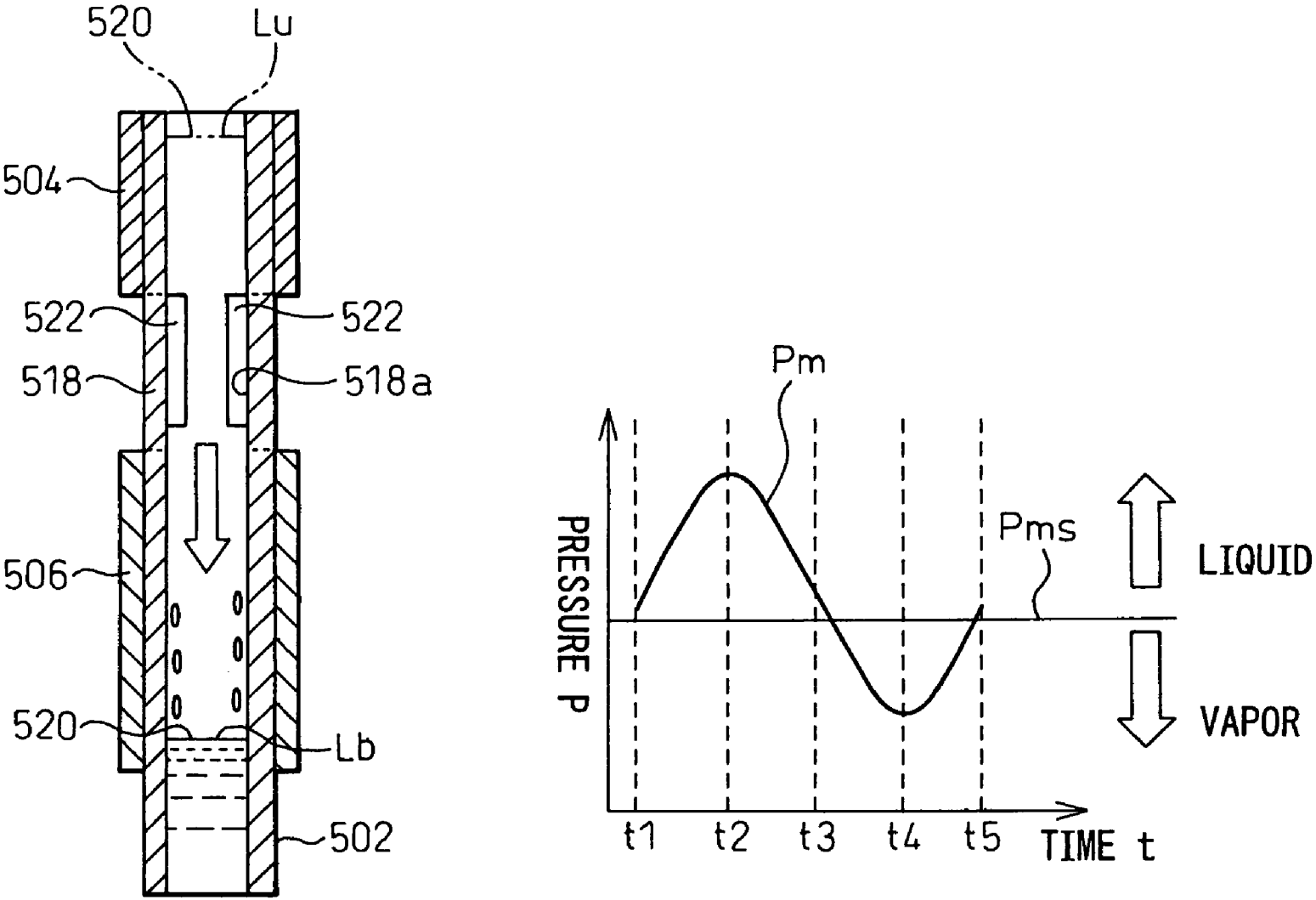
FIG. 6 is a schematic illustration for explaining problems caused in the conventional steam engine by using a partially enlarged view of the broken-line elliptical portion shown in FIG. 5.

For example, concerning the different direction extending tube 40, it is possible to use a different direction extending tube 50 shown in FIG. 4.

The different direction extending tube 50 is a cylindrical portion, the lateral cross-section of which is substantially circular. Specifically, the different direction extending tube 50 includes: a lower side tube portion 52; a central interposition plate 54; and an upper side tube portion 56.

The lower side tube portion 52 includes: a substantially circular hollow portion 52*a* provided on an upper face of the lower side tube portion 52 concerned; and a through-hole 52*b*, which is vertically formed at the center of the hollow portion 52*a*, for communicating the hollow portion 52 with the inside of the connecting tube portion 26.

The central interposition plate 54 is a plate-shaped member which is provided on an upper face of the lower side tube portion 52 and laminated so that it can block the hollow portion 52*a*. At a plurality of positions in the periphery of the central interposition plate 54, through-holes 54*a* penetrating the central interposition plate 54 in the vertical direction are formed.

The upper side tube portion 56 is a member laminated on an upper face of the central interposition plate 54 so that it can cover the through-holes 54*a*. On a lower face of the upper side tube portion 56, the hollow portion 56*a* is provided.

An outer face portion of the different direction extending tube 50 is formed out of a heater 30C for heating the liquid in the different direction extending tube 50 through the different direction extending tube 50 so as to vaporize the liquid in the different direction extending tube 50.

In the case of using the different direction extending tube 50, the liquid flowing into the different direction extending tube 50 flows in a space between the lower side tube portion 52 and the central interposition plate 54 in various horizontal direction. In this case, the connecting tube portion flowing direction Fa (the vertical direction) is different from the flowing direction (substantially horizontal various directions; the heater tube portion flowing direction) of the liquid in a portion (the different direction extending tube 50) of the tube 10B in which the heater 30C is provided. In the case of using the different direction extending tube 50, a portion corresponding to the top dead center Lu of Embodiment 1 is, for example, the top dead center LuC in the different direction extending tube 50.

In the steam engine 1B in this case, at an end portion of the heater 30C (the different direction extending tube 50) on the connecting tube portion 28 side, a hollow portion 52*c* having the same function as that of the hollow portion 44 is provided. Therefore, between the heater 30C (the different direction extending tube 50) and the connecting tube portion 28, a gap 52*d* is formed by the recess portion 52*c*.

Accordingly, in the steam engine 1B of this case, as compared with a case in which the heater 30C (the different direction extending tube 50) and the connecting tube portion 28 come into contact with each other, a quantity of total heat transmitted from the heater 30C (the different direction extending tube 50) to the connecting tube portion 28 can be reduced since the heater 30C (the different direction extending tube 50) and the connecting tube portion 28 are separate from each other.

As a result, in the steam engine 1B of this case, as compared with a case in which the heater 30C (the different direction extending tube 50) and the connecting tube portion 28 come into contact with each other, the quantity of liquid drops to be vaporized attached to the connecting tube portion can be reduced. According to this reduction of the quantity of liquid drops to be vaporized, the thermal efficiency can be enhanced.

In this connection, in Embodiment 3, the steam engine 1B is composed so that the gap 46, 52*d* can be formed between the end portion of the heater 30B, 30C (the different direction extending tube 40, 50) on the connecting tube portion 28 side and the connecting tube portion 28. In the gap 46, 52*d*, an interposition (an interposition, the heat conductivity of which is approximately 0.025 W/m·k) except for air, the heat conductivity of which is the same as that of air, may be interposed. In this case, the same operational effect as that of Embodiment 3 can be provided.

In the case where it is necessary to interpose a heat insulating material 60 in the gap 46, 52*d* for the object of composing the steam engine 1B, it is possible to adopt a structure in which the heat insulating material 60 is provided.

In this case, as the heat insulating material 60 is interposed between the heater 30B, 30C (the different direction extending tube 40, 50) and the connecting tube portion 26, as compared with a case in which the heater 30B, 30C (the different direction extending tube 40, 50) and the connecting tube portion 26 are directly contacted with each other, a quantity of total heat transmitted from the heater 30B, 30C (the different direction extending tube 40, 50) to the connecting tube portion 26 can be reduced.

Accordingly, in this case, as compared with a case in which the heater 30B, 30C (the different direction extending tube 40, 50) and the connecting tube portion 26 are directly contacted with each other, the quantity of liquid drops to be vaporized attached to the connecting tube portion after the movement of the liquid level can be reduced. According to this reduction of the quantity of liquid drops to be vaporized, the thermal efficiency can be enhanced.

In this connection, various heat insulating materials 60 can be used. Examples of the heat insulating materials 60 are: a resin heat insulating material such as fluorine resin (tetrafluoroethylene), PEEK (polyether etherketone) and PPS (polyphenylene sulfide); and inorganic heat insulating material such as glass wool and ceramics (alumina). It is preferable that the heat conductivity of the heat insulating material 60 is not more than 0.5 W/m·K.

Others

In the steam engine 1 of Embodiment 1, the wall thickness of the connecting tube portion 22 may be smaller than the wall thickness of the heater adjacent tube portion 26 in the same manner as that of Embodiment 2.

In this case, the thermal efficiency of the steam engine 1 can be further enhanced by the synergistic effect of the aforementioned operational effect described in Embodiment 1 and the aforementioned operational effect described in Embodiment 2.

The connecting tube portion 22 of Embodiment 1 (including a structure in which the wall thickness of the connecting tube portion 22 is reduced to be smaller than the wall thickness of the heater adjacent tube portion 26 as described before) or the connecting tube portion 24 of Embodiment 2 may be composed of a member used for the connecting pipe portion 22, 24 separate from the heater adjacent tube portion 26.

In this case, the connecting tube portion 22, 24 member and the heater adjacent tube portion 26 tube member are joined to each other, for example, by means of welding or screwing. In this way, the connecting tube portion 22, 24 member and the heater adjacent tube portion 26 tube member are composed as a continuous portion in the tube 10.

When the steam engine 1, 1A is composed as described above, a seam is formed between the connecting tube portion 22, 24 member and the heater adjacent tube portion 26 member. When the seam is formed as described above, as compared with a case in which no seam is formed (in the case where the connecting tube portion 22, 24 member and the heater adjacent tube portion 26 member are composed as an integrated tube member having no seam), the heat transmission efficiency from the heater adjacent tube portion 26 to the connecting tube portion 22, 24 is lowered.

In this case, according to the reduction of the heat transmission efficiency described above, it is possible to reduce a quantity of total heat transmitted from the heater 30 (the heater adjacent tube portion 26) to the connecting tube portion 22, 24. Accordingly, it is possible to reduce a quantity of total heat transmitted from the connecting tube portion 22, 24 to the fluid in the connecting tube portion 22, 24. As a result, according to the reduction of the quantity of total heat, it is possible to reduce a quantity of liquid drops to be vaporized attached to the connecting tube portion after the movement of the liquid level can be reduced.

Accordingly, in the steam engine 1, 1A of this case, the quantity of liquid drops to be vaporized attached to the connecting tube portion after the movement of the liquid level can be reduced. According to the reduction of the quantity of liquid drops to be vaporized, it is possible to suppress the occurrence of a phenomenon in which the useless heat not contributing to the expansion of the fluid volume in the tube is carried to a neighborhood of the cooler 32 by the vapor. According to the steam engine in this case, the thermal efficiency can be enhanced by this suppression.

In this case, it is preferable that materials of the connecting tube portion 22, 24 and the heater adjacent tube portion 26 are selected so that the heat conductivity of the connecting tube portion 22, 24 can be lower than that of the heater adjacent tube portion 26.

Due to the foregoing, a quantity of total heat transmitted from the heater 30 (the heater adjacent tube portion 26) to the connecting tube portion 22, 24 member can be further reduced. Accordingly, a quantity of liquid drops to be vaporized attached to the connecting tube portion after the movement of the liquid level can be further reduced. According to the reduction of the quantity of liquid drops to be vaporized attached to the connecting tube portion after the movement of the liquid level, the thermal efficiency of the steam engine 1, 1A can be further enhanced.

In the steam engine 1, 1A of Embodiments 1 and 2 (The steam engine 1 of Embodiment 1 includes an embodiment in which the wall thickness of the connecting tube portion 22 is reduced to be smaller than the wall thickness of the heater adjacent tube portion 26.), the vertical direction extending tube 12 may bent between the heater adjacent tube portion 26 and the connecting tube portion 22, 24 so that a flowing direction of the liquid in the heater adjacent tube portion 26 can be different from that of the connecting tube portion 22, 24.

In this case, when the vertical direction extending tube 12 is bent so that a gap can be formed between the end portion of the heater 30 on the connecting tube portion 22, 24 side and the connecting tube portion 22, 24, by the same operational effect as that of Embodiment 3, the heat efficiency of the steam engine 1, 1A can be enhanced as compared with a case in which the end portion of the heater 30 on the connecting tube portion 22, 24 side and the connecting tube portion 22, 24 are contacted with each other.

In the steam engine 1, 1A of Embodiments 1 and 2 (The steam engine 1 of Embodiment 1 includes an embodiment in which the wall thickness of the connecting tube portion 22 is reduced to be smaller than the wall thickness of the heater adjacent tube portion 26.), a member 62 (shown in FIGS. 1 and 2), the heat conductivity of which is lower than that of the material composing the heater adjacent tube portion 26, may be arranged on an outer circumferential face of the connecting tube portion 22, 24.

Due to the foregoing, as compared with a case in which the low heat conductivity material member 62 is not arranged, it is possible to reduce a quantity of total heat flowing into the connecting tube portion 22, 24 from the heater 30 through the outside air. Therefore, a quantity of liquid drops to be vaporized attached to the connecting tube portion after the movement of the liquid level can be reduced. According to the reduction of the quantity of liquid drops to be vaporized attached to the connecting tube portion after the movement of the liquid level, the thermal efficiency of the steam engine 1, 1A can be further enhanced.

In this connection, the low heat conductivity material member 62 may be provided not only on the outer circumferential face of the connecting tube portion 22, 24 but also on the inner wall face of the connecting tube portion 22, 24 or inside the connecting tube portion 22, 24. Even in this case, it is possible to provide the substantially same effect as that of the case in which the low heat conductivity material member 62 is provided on the outer circumferential face of the connecting tube portion 22, 24.

While the invention has been described by reference to specific embodiments chosen for purposes of illustration, it should be apparent that numerous modifications could be made thereto, by those skilled in the art without, departing from the basic concept and scope of the invention.

The invention claimed is:

1. A steam engine comprising:

a tube into which liquid is charged;

a heater for heating the liquid in the tube; and a cooler for cooling vapor generated when the liquid is vaporized being heated by the heater, wherein a fluid displacement of the liquid in the tube is generated by vaporization of the liquid when it is heated by the heater and liquefaction of the vapor when it is cooled by the cooler, the heater and the cooler are arranged at an interval in the tube line formed by the tube, and an entire inner wall face of a connecting tube portion, which is a portion extending from the heater to the cooler, is formed out of a water repellent finish face.

2. A steam engine according to claim 1, wherein
the water repellent finish face is formed when the inner wall face of the connecting tube portion is subjected to mirror finish processing.

3. A steam engine according to claim 1, wherein
the water repellent finish face is formed when the inner wall face of the connecting tube portion is coated with a predetermined material.

4. A steam engine comprising:
a tube into which liquid is charged;
a heater for heating the liquid in the tube; and
a cooler for cooling vapor generated when the liquid is vaporized being heated by the heater, wherein
a fluid displacement of the liquid in the tube is generated by vaporization of the liquid when it is heated by the heater and liquefaction of the vapor when it is cooled by the cooler,
the heater is provided being adjacent to a portion of the tube so as to heat liquid in the portion of the tube,
the heater and the cooler are arranged at an interval in the tube line formed by the tube, and
a wall thickness of at least a portion of a connecting tube portion, which is a portion between the heater and the cooler, is smaller than a wall thickness of a portion of the tube adjacent to the heater.

5. A steam engine according to claim 4, wherein
the wall thickness of the entire connecting tube portion is smaller than the wall thickness of a portion of the tube adjacent to the heater.

6. A steam engine comprising:
a tube into which liquid is charged;
a heater for heating the liquid in the tube; and
a cooler for cooling vapor generated when the liquid is vaporized being heated by the heater, wherein
a fluid displacement of the liquid in the tube is generated by vaporization of the liquid when it is heated by the heater and liquefaction of the vapor when it is cooled by the cooler,
the heater is provided being adjacent to a heating portion of the tube to heat liquid in the heating portion of the tube,
a connecting tube portion defined by the tube is a portion extending from the heater to the cooler, the connecting tube portion being separate from the heating portion of the tube, and
the connecting tube portion and the heating portion of the tube are joined to each other.

7. A steam engine according to claim 6, wherein
the heat conductivity of material composing the connecting tube portion is lower than the heat conductivity of material composing the heating portion of the tube member for a portion of the tube adjacent to the heater.

8. A steam engine comprising:
a tube into which liquid is charged;
a heater for heating the liquid in a heatinci portion of the tube, the heater being in direct contact with the entire heating portion of the tube; and
a cooler for cooling vapor generating when the liquid is vaporized being heated by the heater, wherein
a fluid displacement of the liquid in the tube is generated by vaporization of the liquid when it is heated by the heater and liquefaction of the vapor when it is cooled by the cooler,
the heater and the cooler are arranged at an interval defined by a connecting tube portion of the tube,
a flowing direction of the liquid in the connecting tube portion is different than a flowing direction of the liquid in the heating portion of the tube, in which the heater is provided,
the heater covers at least a part of the connecting tube portion of the tube; and
a gap is formed between the heater and the part of the connecting tube portion.

9. A steam engine according to claim 8, wherein
a heat insulating material member is arranged in the gap.

10. A steam engine according to claim 8, wherein
the gap is provided when a recess portion is formed in a portion of the heater.

11. A steam engine according to claim 1, further comprising:
an output portion for taking out a fluid displacement of the liquid in the tube, which is generated by vaporization of the liquid when it is heated by the heater and liquefaction of the vapor when it is cooled by the cooler, as mechanical energy.

12. A steam engine according to claim 1, wherein
the heater is arranged in an upper portion of the cooler.

* * * * *